US011371758B2

(12) United States Patent
Nakamura

(10) Patent No.: US 11,371,758 B2
(45) Date of Patent: Jun. 28, 2022

(54) REFRIGERATION CYCLE APPARATUS

(71) Applicant: Mitsubishi Electric Corporation, Tokyo (JP)

(72) Inventor: Shin Nakamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/976,273

(22) PCT Filed: Apr. 11, 2018

(86) PCT No.: PCT/JP2018/015225
§ 371 (c)(1),
(2) Date: Aug. 27, 2020

(87) PCT Pub. No.: WO2019/198175
PCT Pub. Date: Oct. 17, 2019

(65) Prior Publication Data

US 2020/0408445 A1 Dec. 31, 2020

(51) Int. Cl.
*F25B 41/22* (2021.01)
*F25B 49/02* (2006.01)
*F25B 5/02* (2006.01)

(52) U.S. Cl.
CPC ..... *F25B 41/22* (2021.01); *F25B 5/02* (2013.01); *F25B 49/02* (2013.01)

(58) Field of Classification Search
CPC .. F25B 41/22; F25B 5/02; F25B 49/02; F25B 13/00
See application file for complete search history.

(56) References Cited

U.S. PATENT DOCUMENTS 3,423,954 A * 1/1969 Harnish ..... F25B 13/00 62/222
4,030,315 A * 6/1977 Harnish ..... F25B 13/00 62/324.4

(Continued)

FOREIGN PATENT DOCUMENTS

EP 1947405 A1 7/2008
FR 2 916 835 A1 12/2008

(Continued)

OTHER PUBLICATIONS

Office Action dated Jul. 6, 2021, issued in corresponding JP Patent Application No. 2020-512993 ( and English translation).

(Continued)

*Primary Examiner* — Miguel A Diaz
(74) *Attorney, Agent, or Firm* — Posz Law Group, PLC

(57) ABSTRACT

A refrigeration cycle apparatus includes a refrigerant circuit, by pipes, connecting a compressor, a flow switching device, a first heat exchanger, an expansion device, and a second heat exchanger. As refrigerant to be circulated through the refrigerant circuit, any one of a refrigerant having saturated gas temperature under standard atmospheric pressure that is higher than that of R32 and a refrigerant mixture mainly composed of the refrigerant is used. The refrigerant circuit includes an internal heat exchanger configured to exchange heat between the refrigerant flowing through a refrigerant-inlet side of the second heat exchanger and the refrigerant flowing through a refrigerant-outlet side of the second heat exchanger.

7 Claims, 6 Drawing Sheets

(56) References Cited

U.S. PATENT DOCUMENTS

| | | | | | |
|---|---|---|---|---|---|
| 5,987,907 | A * | 11/1999 | Morimoto | F25B 13/00 | 62/212 |
| 7,353,664 | B2 * | 4/2008 | Kim | F25B 13/00 | 62/176.3 |
| 2005/0039897 | A1 * | 2/2005 | Muto | F25B 40/00 | 165/164 |
| 2009/0013700 | A1 * | 1/2009 | Unezaki | F25B 13/00 | 62/77 |
| 2010/0005831 | A1 * | 1/2010 | Vaisman | F25B 1/10 | 62/470 |
| 2010/0058800 | A1 * | 3/2010 | Setoguchi | F28D 7/0016 | 62/513 |
| 2010/0131115 | A1 * | 5/2010 | Kim | F25B 13/00 | 700/282 |
| 2010/0326095 | A1 * | 12/2010 | Van Horn | C09K 5/044 | 62/77 |
| 2012/0199326 | A1 * | 8/2012 | Sheldon | F28D 7/106 | 165/154 |
| 2013/0325732 | A1 * | 12/2013 | Low | F25B 45/00 | 705/317 |
| 2014/0290292 | A1 * | 10/2014 | Kato | F25B 13/00 | 62/190 |
| 2015/0096311 | A1 * | 4/2015 | Johnson | F28D 1/0435 | 62/89 |
| 2015/0276271 | A1 * | 10/2015 | Uselton | F25B 21/02 | 62/115 |
| 2016/0223239 | A1 * | 8/2016 | Hancock | F25B 13/00 | |
| 2017/0299241 | A1 * | 10/2017 | Ishikawa | F25B 9/008 | |
| 2017/0343288 | A1 * | 11/2017 | Joardar | F28F 19/006 | |
| 2018/0112897 | A1 * | 4/2018 | Jindou | F25B 39/02 | |

FOREIGN PATENT DOCUMENTS

| | | | | |
|---|---|---|---|---|
| JP | H05-141811 | A | 6/1993 | |
| JP | 2001-227822 | A | 8/2001 | |
| JP | 2003-194432 | A | 7/2003 | |
| JP | 2003194432 | A * | 7/2003 | F25B 13/00 |
| JP | 2007-085591 | A | 4/2007 | |
| JP | 2009-250592 | A | 10/2009 | |
| JP | 2009-299909 | A1 | 12/2009 | |
| JP | 2011-043279 | A | 3/2011 | |
| JP | 2012-132578 | A | 7/2012 | |
| JP | 2012132578 | A * | 7/2012 | |
| JP | 5991989 | B2 | 9/2016 | |

OTHER PUBLICATIONS

International Search Report of the International Searching Authority dated Jun. 19, 2018 for the corresponding International application No. PCT/JP2018/015225 (and English translation).

Extended European Search Report dated Mar. 5, 2021, issued in corresponding European Patent Application No. 18914807.5.

* cited by examiner

REFRIGERATION CYCLE APPARATUS

CROSS REFERENCE TO RELATED APPLICATION

This application is a U.S. national stage application of PCT/JP2018/015225 filed on Apr. 11, 2018, the contents of which are incorporated herein by reference.

TECHNICAL FIELD

The present disclosure relates to a refrigeration cycle apparatus using a flammable refrigerant or a refrigerant mixture mainly composed of the refrigerant as refrigerant to be circulated through a refrigerant circuit.

BACKGROUND ART

There is a demand to change refrigerant for use in refrigeration cycle apparatuses to refrigerants having low global warming potentials (GWPs) in consideration of influence on global warming. The global warming potential is an index showing the degree of influence on global warming. The global warming potential is hereinafter called GWP. In view of the demand, in the field of refrigeration cycle apparatuses such as air-conditioning apparatuses, some HFC refrigerants such as R410A have been replaced with an R32 refrigerant. This is because the GWP of R410A is "2088" but the GWP of R32 is "675".

There is also an expectation that artificial HFC refrigerants will be replaced with natural HC refrigerants in the future. Among the HC refrigerants, R290 is favorable because its theoretical COP is higher than that of R32. The GWP of R290 is "3". However, the HC refrigerant is flammable and therefore needs to be charged into apparatuses in an amount that ensures safety in case of leakage into rooms. That is, the refrigerant charging amount needs to be reduced so that the concentration of the refrigerant is lower than a lower limit value of a refrigerant combustion concentration in case of leakage.

In view of such need, Patent Literature 1 describes that "surplus accumulation of liquid refrigerant, which may significantly influence determination of the refrigerant charging amount, is eliminated and the COP is improved so that the refrigerating and air-conditioning apparatus is downsized and the refrigerant charging amount is reduced."

CITATION LIST

Patent Literature

Patent Literature 1: Japanese Unexamined Patent Application Publication No. 2001-227822

SUMMARY OF INVENTION

Technical Problem

In an air-conditioning apparatus using R290 as refrigerant as described in Patent Literature 1, a pressure loss in a pipe is significant. In a cooling condition in which an indoor heat exchanger operates as an evaporator, in particular, a refrigerant pressure loss in an extension pipe after heat exchange significantly influences a decrease in performance. To reduce the pressure loss in the extension pipe, it is effective that the refrigerant flows in a superheated gas state instead of a two-phase state. If the evaporator exchanges heat so that the refrigerant turns into superheated gas refrigerant, however, the heat exchange performance significantly decreases because of influence of refrigerant distribution and influence of a decrease in heat transfer performance caused by dryout in the pipe. Therefore, R290 has a problem in that the loss of evaporator performance is significant compared with some refrigerants such as R32.

The present disclosure has been made in view of the problem described above and has an object to provide a refrigeration cycle apparatus whose performance does not decrease.

Solution to Problem

A refrigeration cycle apparatus according to an embodiment of the present disclosure includes a refrigerant circuit, by pipes, connecting a compressor, a flow switching device, a first heat exchanger, an expansion device, and a second heat exchanger. As refrigerant to be circulated through the refrigerant circuit, any one of a refrigerant having saturated gas temperature under standard atmospheric pressure that is higher than that of R32 and a refrigerant mixture mainly composed of the refrigerant is used. The refrigerant circuit includes an internal heat exchanger configured to exchange heat between the refrigerant flowing through a refrigerant-inlet side of the second heat exchanger and the refrigerant flowing through a refrigerant-outlet side of the second heat exchanger.

Advantageous Effects of Invention

As the refrigeration cycle apparatus according to an embodiment of the present disclosure includes the internal heat exchanger, the refrigerant at the refrigerant outlet of the second heat exchanger can be brought into the two-phase state and the refrigerant to be suctioned into the compressor can be brought into the superheated gas state. Thus, the performance does not decrease in the refrigeration cycle apparatus according to an embodiment of the present disclosure.

DESCRIPTION OF EMBODIMENTS

Figure 1:
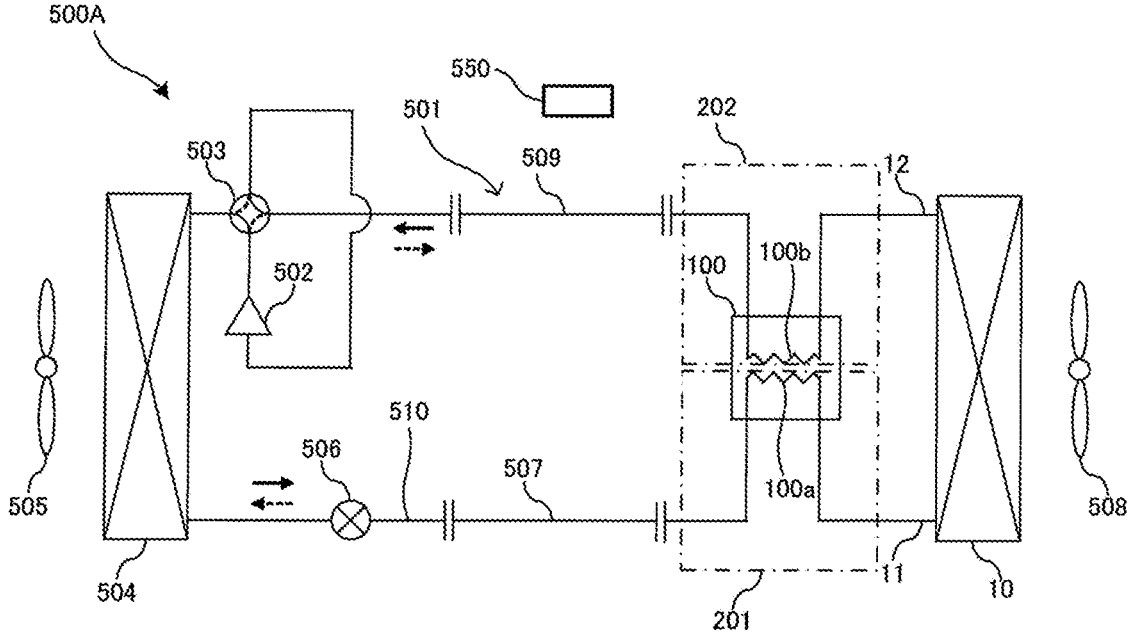
FIG. 1 is an overall structural diagram schematically illustrating an example of the structure of a refrigerant circuit of a refrigeration cycle apparatus according to Embodiment 1 of the present disclosure.

Embodiments 1 to 3 of the present disclosure are described below with reference to the drawings as appropriate. Note that, in the drawings including FIG. 1 to which reference is made below, the size relationship between constituent elements may differ from an actual size relationship. Further, in the drawings including FIG. 1 to which reference is made below, elements represented by the same reference signs are identical or corresponding elements and are common throughout the description herein. Further, the forms of constituent elements that are defined throughout the description herein are illustrative in all respects and the forms are not limited to those in the description.

Embodiment 1

FIG. 1 is an overall structural diagram schematically illustrating an example of the structure of a refrigerant circuit of a refrigeration cycle apparatus 500A according to Embodiment 1 of the present disclosure. The refrigeration cycle apparatus 500A is described with reference to FIG. 1. In FIG. 1, the refrigeration cycle apparatus 500A is described as, for example, an air-conditioning apparatus. Further, in FIG. 1, the solid arrows represent a flow of refrigerant when a first heat exchanger 504 is used as a condenser, and the dashed arrows represent a flow of refrigerant when the first heat exchanger 504 is used as an evaporator.

<Overall Structure of Refrigeration Cycle Apparatus 500A>

The refrigeration cycle apparatus 500A includes a refrigerant circuit 501. The refrigerant circuit 501 is formed by connecting a compressor 502, a flow switching device 503, the first heat exchanger 504, an expansion device 506, a first passage 100*a* of an internal heat exchanger 100, a second heat exchanger 10, and a second passage 100*b* of the internal heat exchanger 100 by a refrigerant pipe 510. The refrigeration cycle apparatus 500A further includes a first fan 505 configured to supply air to the first heat exchanger 504, and a second fan 508 configured to supply air to the second heat exchanger 10. The refrigeration cycle apparatus 500A further includes a first extension pipe 507 connecting the expansion device 506 and the first passage 100*a* of the internal heat exchanger 100, and a second extension pipe 509 connecting the second passage 100*b* of the internal heat exchanger 100 and the flow switching device 503.

Note that FIG. 1 illustrates a second-heat-exchanger liquid port 11, which is a port of the second heat exchanger 10 connected to the first passage 100*a* of the internal heat exchanger 100, and a second-heat-exchanger gas port 12, which is a port of the second heat exchanger 10 connected to the second passage 100*b* of the internal heat exchanger 100. Further, FIG. 1 illustrates a first area 201, which is an area located between the second-heat-exchanger liquid port 11 and the first extension pipe 507, and a second area 202, which is an area located between the second-heat-exchanger gas port 12 and the second extension pipe 509. The second-heat-exchanger liquid port 11 is a refrigerant inlet, and the second-heat-exchanger gas port 12 is a refrigerant outlet.

The compressor 502 compresses refrigerant. The refrigerant compressed by the compressor 502 is discharged from the compressor 502 and sent to the first heat exchanger 504 or the second heat exchanger 10. Examples of the compressor 502 may include a rotary compressor, a scroll compressor, a screw compressor, and a reciprocating compressor.

The flow switching device 503 is provided on a discharge port of the compressor 502 and switches flows of refrigerant. As illustrated in FIG. 1, the flow switching device 503 may be a four-way valve. Alternatively, the flow switching device 503 may be a combination of two-way valves or a combination of three-way valves. Note that, depending on the refrigeration cycle apparatus 500A, the refrigerant may be circulated in a predetermined direction without the flow switching device 503.

The first heat exchanger 504 is used as a condenser or an evaporator. The first heat exchanger 504 exchanges heat between refrigerant flowing through the refrigerant circuit 501 and air supplied from the first fan 505 to condense or evaporate the refrigerant. Examples of the first heat exchanger 504 may include a fin-and-tube heat exchanger, a microchannel heat exchanger, a heat-pipe heat exchanger, a plate heat exchanger, and a double-pipe heat exchanger. Note that the first heat exchanger 504 herein exchanges heat between air and refrigerant as an example, but may exchange heat between refrigerant and a heat medium such as water and brine. In this case, a heat-medium sending device such as a pump may be disposed in place of the first fan 505.

The expansion device 506 expands refrigerant flowing out of the first heat exchanger 504 or the second heat exchanger 10 to reduce a pressure of the refrigerant. Examples of the expansion device 506 may include an electric expansion valve configured to control the flow rate of refrigerant. Note that the expansion device 506 is not limited to the electric expansion valve but may be, for example, a mechanical expansion valve that employs a diaphragm as a pressure receiving portion, or a capillary tube.

The second heat exchanger 10 is used as an evaporator or a condenser. The second heat exchanger 10 exchanges heat between refrigerant flowing through the refrigerant circuit 501 and air supplied from the second fan 508 to evaporate or condense the refrigerant. Examples of the second heat exchanger 10 may include a fin-and-tube heat exchanger, a microchannel heat exchanger, a heat-pipe heat exchanger, a plate heat exchanger, and a double-pipe heat exchanger. Note that the second heat exchanger 10 herein exchanges heat between air and refrigerant as an example, but may exchange heat between refrigerant and a heat medium such as water and brine. In this case, a heat-medium sending device such as a pump may be disposed in place of the second fan 508.

The internal heat exchanger 100 exchanges heat between refrigerant flowing through the first passage 100*a* in the first area 201 and refrigerant flowing through the second passage 100*b* in the second area 202. Specifically, the internal heat exchanger 100 exchanges heat between low-pressure and low-quality two-phase gas-liquid refrigerant flowing through the first area 201 and low-pressure and high-quality two-phase gas-liquid refrigerant or single-phase gas refrigerant flowing through the second area 202. Note that the structure of the internal heat exchanger 100 is described later in detail.

The compressor 502, the flow switching device 503, the first heat exchanger 504, the first fan 505, and the expansion device 506 are mounted in a heat source-side unit. If the heat source-side unit is an outdoor unit, the first heat exchanger 504 is used as an outdoor heat exchanger. The second heat exchanger 10, the second fan 508, and the internal heat exchanger 100 are mounted in a load-side unit. If the load-side unit is an indoor unit, the second heat exchanger 10 is used as an indoor heat exchanger. Therefore, a cooling operation is executed when the first heat exchanger 504 is used as the condenser, and a heating operation is executed when the first heat exchanger 504 is used as the evaporator.

The refrigeration cycle apparatus 500A further includes a controller 550 configured to perform centralized control over the entire refrigeration cycle apparatus 500A. The controller 550 controls a driving frequency of the compressor 502. Further, the controller 550 controls the opening degree of the expansion device 506 depending on operating conditions. Still further, the controller 550 controls driving of the first fan 505, the second fan 508, and the flow switching device 503. That is, the controller 550 controls actuators of devices such as the compressor 502, the expansion device 506, the first fan 505, the second fan 508, and the flow switching device 503 in response to operation instructions by using information sent from temperature sensors and pressure sensors, which are not illustrated.

Functional elements of the controller 550 are implemented by dedicated hardware or a micro-processing unit (MPU) configured to execute programs stored in a memory.

The refrigerant pipe 510 includes the first extension pipe 507 and the second extension pipe 509. Further, the refrigerant that fills the refrigerant circuit 501 is a refrigerant having a saturated gas temperature under standard atmospheric pressure that is higher than that of R32, or a refrigerant mixture mainly composed of this refrigerant. Further, it is appropriate that the refrigerant that fills the refrigerant circuit 501 be a low-GWP and flammable HC natural refrigerant, or a refrigerant mixture mainly composed of this refrigerant. Compared with R32, these refrigerants have a low pressure at the same saturated gas temperature, a low density, a significant refrigerant pressure loss to a circulation amount, a significant refrigerant pressure loss at the same capacity represented by "kW", and a significant influence on a decrease in performance. The capacity is expressed by "circulation amount×refrigeration effect". The refrigeration effect means an enthalpy difference. Although the refrigeration effect varies depending on the refrigerant in actuality, R32 has a great refrigeration effect and therefore the circulation amount decreases.

Examples of the refrigerant that fills the refrigerant circuit 501 include R1234yf and R1234ze, which are refrigerants having GWP values of 10 or less. These refrigerants have such characteristics that the saturated gas temperatures under standard atmospheric pressure are −29 degrees Celsius and −19 degrees Celsius, which are higher than −52 degrees Celsius of R32. Examples of the refrigerant that fills the refrigerant circuit 501 further include R454A, R454C, and R455A, which are refrigerant mixtures of R1234yf or R1234ze and R32. Examples of the refrigerant that fills the refrigerant circuit 501 further include R448A and R463A, which are refrigerant mixtures obtained by adding R134a or other refrigerants to the refrigerant mixtures described above. Examples of the refrigerant that fills the refrigerant circuit 501 further include R1123 and $CO_2$-containing refrigerants, which are refrigerants singly having saturated gas temperatures under standard atmospheric pressure that are lower than that of R32. These refrigerants having saturated gas temperatures under standard atmospheric pressure that are lower than that of R32 have a significant refrigerant pressure loss at the same capacity and a significant influence on a decrease in performance compared with R32. Therefore, these refrigerants are likely to have problems in terms of the decrease in performance. Further, examples of lubricating oil that lubricates a sliding portion of the compressor 502 include polyalkylene glycol (PAG) having an ether bond, and polyolester (POE) having an ester bond.

<Operations of Refrigeration Cycle Apparatus 500A>

Operations of the refrigeration cycle apparatus 500A are described in association with flows of refrigerant. The refrigeration cycle apparatus 500A is configured to operate in response to an instruction from the load side so that the first heat exchanger 504 is used as the condenser or the evaporator. Note that operations of the actuators are controlled by the controller 550. Description is first made of an operation of the refrigeration cycle apparatus 500A when the first heat exchanger 504 is used as the condenser. Description is then made of an operation of the refrigeration cycle apparatus 500A when the first heat exchanger 504 is used as the evaporator.

(Operation Under Refrigerant Flow of Solid Arrows)

Low-temperature and low-pressure refrigerant is compressed into high-temperature and high-pressure gas refrigerant by the compressor 502. The high-temperature and high-pressure gas refrigerant is discharged from the compressor 502. The high-temperature and high-pressure gas refrigerant discharged from the compressor 502 flows into the first heat exchanger 504 through the flow switching device 503. The refrigerant flowing into the first heat exchanger 504 exchanges heat with air supplied from the first fan 505. At this time, the refrigerant is condensed into high-pressure liquid refrigerant. The high-pressure liquid refrigerant flows out of the first heat exchanger 504. Further, the air is heated.

The high-pressure liquid refrigerant flowing out of the first heat exchanger 504 then turns into low-pressure and low-quality two-phase gas-liquid refrigerant through the expansion device 506. The two-phase gas-liquid refrigerant flows through the first extension pipe 507, through the first passage 100*a* in the first area 201, and into the second heat exchanger 10 at the second-heat-exchanger liquid port 11. The second heat exchanger 10 is used as the evaporator. That is, the low-pressure and low-quality two-phase gas-liquid refrigerant flowing into the second heat exchanger 10 is evaporated by exchanging heat with air supplied from the second fan 508 to turn into low-pressure and high-quality two-phase gas-liquid refrigerant or single-phase gas refrigerant.

The low-pressure and high-quality two-phase gas-liquid refrigerant or single-phase gas refrigerant flows out of the second heat exchanger 10 at the second-heat-exchanger gas port 12. The low-pressure and high-quality two-phase gas-liquid refrigerant or single-phase gas refrigerant flowing out of the second heat exchanger 10 flows through the second passage 100*b* in the second area 202, through the second extension pipe 509, and into the flow switching device 503. The refrigerant flows to a suction port of the compressor 502 and is compressed and discharged again.

(Operation Under Refrigerant Flow of Dashed Arrows)

Low-temperature and low-pressure refrigerant is compressed into high-temperature and high-pressure gas refrigerant by the compressor 502. The high-temperature and high-pressure gas refrigerant is discharged from the compressor 502. The high-temperature and high-pressure gas refrigerant discharged from the compressor 502 flows through the flow switching device 503, through the second extension pipe 509, through the second passage 100*b* in the second area 202, and into the second heat exchanger 10 at the second-heat-exchanger liquid port 11. The refrigerant flowing into the second heat exchanger 10 exchanges heat with air supplied from the second fan 508. At this time, the refrigerant is condensed into high-pressure liquid refrigerant. The high-pressure liquid refrigerant flows out of the second heat exchanger 10 at the second-heat-exchanger liquid port 11. Further, the air is heated.

The high-pressure liquid refrigerant flowing out of the second heat exchanger 10 flows through the first passage 100*a* in the first area 201 and then through the first extension pipe 507. The high-pressure liquid refrigerant turns into low-pressure and low-quality two-phase gas-liquid refrigerant through the expansion device 506. The two-phase gas-liquid refrigerant flows into the first heat exchanger 504. The first heat exchanger 504 is used as the evaporator. That is, the low-pressure and low-quality two-phase gas-liquid refrigerant flowing into the first heat exchanger 504 is evaporated by exchanging heat with air supplied from the first fan 505 to turn into low-pressure and high-quality two-phase gas-liquid refrigerant or single-phase gas refrigerant.

The low-pressure and high-quality two-phase gas-liquid refrigerant or single-phase gas refrigerant flows out of the first heat exchanger 504. The low-pressure and high-quality two-phase gas-liquid refrigerant or single-phase gas refrigerant flowing out of the first heat exchanger 504 flows into the flow switching device 503. The refrigerant flows to the suction port of the compressor 502 and is compressed and discharged again.

<Examples of Structure of Internal Heat Exchanger 100>

Figure 2:
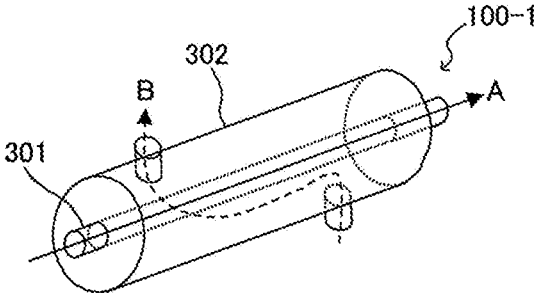
FIG. 2 is a structural diagram schematically illustrating an example of the structure of an internal heat exchanger of the refrigeration cycle apparatus according to Embodiment 1 of the present disclosure.
Figure 3:
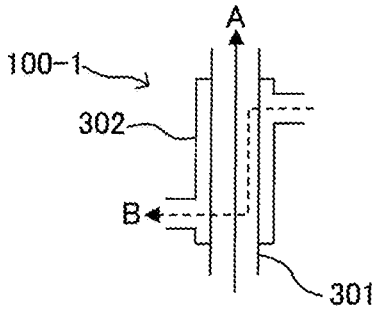
FIG. 3 is a structural diagram schematically illustrating the example of the structure of the internal heat exchanger of the refrigeration cycle apparatus according to Embodiment 1 of the present disclosure.
Figure 4:
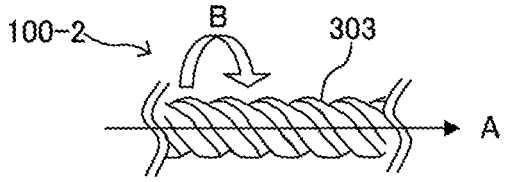
FIG. 4 is a structural diagram schematically illustrating another example of the structure of the internal heat exchanger of the refrigeration cycle apparatus according to Embodiment 1 of the present disclosure.
Figure 5:
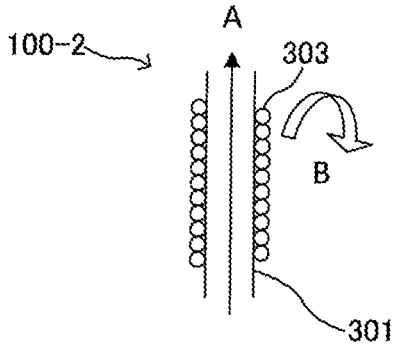
FIG. 5 is a structural diagram schematically illustrating the example of the structure of the internal heat exchanger of the refrigeration cycle apparatus according to Embodiment 1 of the present disclosure.
Figure 6:
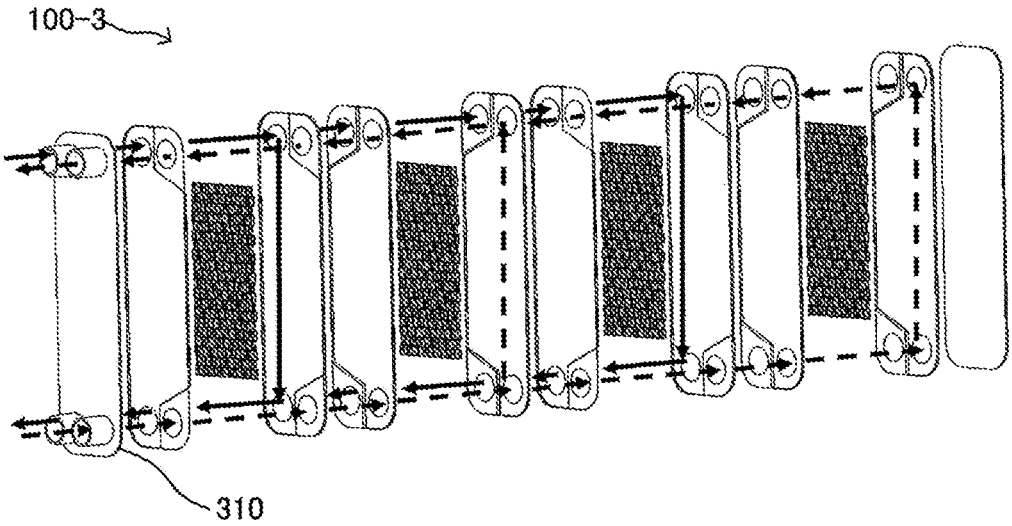
FIG. 6 is a structural diagram schematically illustrating still another example of the structure of the internal heat exchanger of the refrigeration cycle apparatus according to Embodiment 1 of the present disclosure.

FIG. 2 to FIG. 6 are structural diagrams schematically illustrating examples of the structure of the internal heat exchanger 100 of the refrigeration cycle apparatus 500A. The examples of the structure of the internal heat exchanger 100 are described with reference to FIG. 2 to FIG. 6. The internal heat exchanger 100 is a refrigerant-to-refrigerant heat exchanger and may have structures illustrated in FIG. 2 to FIG. 6. The internal heat exchanger 100 illustrated in FIG. 2 and FIG. 3 is referred to as an internal heat exchanger 100-1. The internal heat exchanger 100 illustrated in FIG. 4 and FIG. 5 is referred to as an internal heat exchanger 100-2. The internal heat exchanger 100 illustrated in FIG. 6 is referred to as an internal heat exchanger 100-3.

FIG. 2 is a transparent perspective view schematically illustrating the structure of the internal heat exchanger 100-1, which is a double-pipe heat exchanger. FIG. 3 is a passage sectional view schematically illustrating passages of the internal heat exchanger 100-1. FIG. 4 is a transparent perspective view schematically illustrating the structure of the internal heat exchanger 100-2, which is a double-pipe heat exchanger. FIG. 5 is a passage sectional view schematically illustrating passages of the internal heat exchanger 100-2. FIG. 6 is a perspective view schematically illustrating the structure of the internal heat exchanger 100-3, which is a plate heat exchanger. Note that the internal heat exchanger 100-2 is another type of double-pipe heat exchanger different from the double-pipe heat exchanger used as the internal heat exchanger 100-1.

As illustrated in FIG. 2 and FIG. 3, the internal heat exchanger 100-1 has an inner pipe 301 and an outer pipe 302 provided outside the inner pipe 301. Thus, in the internal heat exchanger 100-1, a fluid A flowing through the inner pipe 301 exchanges heat with a fluid B flowing through the outer pipe 302. Note that the inside of each of the inner pipe 301 and the outer pipe 302 may have grooves or projections for promotion of heat transfer.

As illustrated in FIG. 4 and FIG. 5, the internal heat exchanger 100-2 has an inner pipe 301 and a twisted pipe 303 provided outside the inner pipe 301 in a helical form. Thus, in the internal heat exchanger 100-2, a fluid A flowing through the inner pipe 301 exchanges heat with a fluid B flowing through the twisted pipe 303. Note that the inside of each of the inner pipe 301 and the twisted pipe 303 may have grooves or projections for promotion of heat transfer.

As illustrated in FIG. 6, the internal heat exchanger 100-3 has a plurality of stacked heat transfer plates 310. Each heat transfer plate 310 has a plurality of rows of wavy projections and wavy recesses. The stacked heat transfer plates 310 have passages represented by solid arrows and passages represented by dashed arrows.

Figure 7:
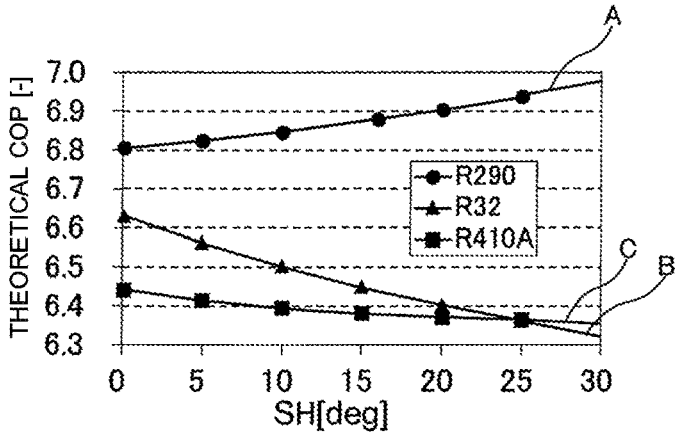
FIG. 7 is a graph showing characteristics of refrigerants.
Figure 8:
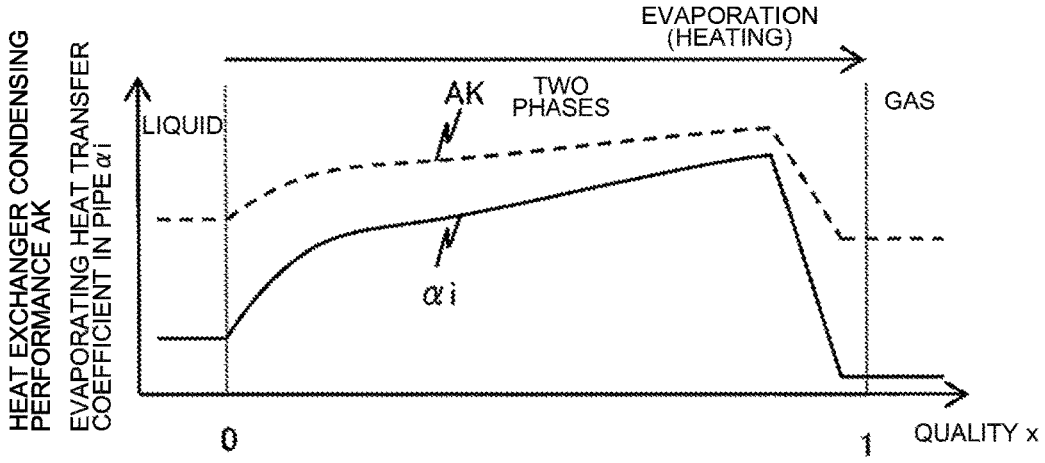
FIG. 8 is a graph showing a relationship between a refrigerant quality and a heat transfer coefficient in a heat transfer pipe widely used.
Figure 9:
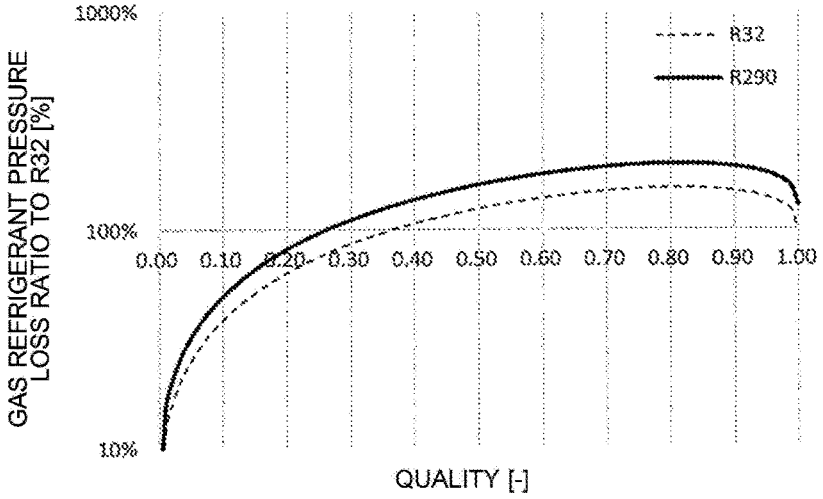
FIG. 9 is a graph showing a relationship between the refrigerant quality and a pressure loss in the heat transfer pipe widely used.

FIG. 7 is a graph showing characteristics of refrigerants. FIG. 8 is a graph showing a relationship between a refrigerant quality and a heat transfer coefficient in a heat transfer pipe widely used. FIG. 9 is a graph showing a relationship between the refrigerant quality and a pressure loss in the heat transfer pipe widely used. Characteristics of R290 are described with reference to FIG. 7 to FIG. 9. In FIG. 7, the vertical axis represents a theoretical COP and the horizontal axis represents SH. Further, the line A represents characteristics of R290, the line B represents characteristics of R32, and the line C represents characteristics of R410A. In FIG. 8, the vertical axis represents heat exchanger condensing performance and an evaporating heat transfer coefficient in the pipe, and the horizontal axis represents a quality. In FIG. 9, the vertical axis represents a gas refrigerant pressure loss ratio to R32, and the horizontal axis represents a quality.

As described above, the refrigerant circuit 501 of the refrigeration cycle apparatus 500A is filled with the low-GWP and flammable HC natural refrigerant, or the refrigerant mixture mainly composed of this refrigerant.

In contrast, in a refrigerant circuit using R32 as refrigerant, the discharge temperature is likely to increase because of the physical properties of R32. The increase in the discharge temperature is reduced usually by operating the compressor at a suction SH of about 0 to about 2. Thus, the compressor is operated to have its discharge temperature lower than or equal to an upper limit value (100 degrees Celsius to 120 degrees Celsius). Accordingly, failure in the compressor is prevented.

An increase in the discharge temperature per degree Celsius in terms of the suction SH at the same compressor efficiency is 1.13 degrees Celsius per degree Celsius for the R32 refrigerant and 0.95 degrees Celsius per degree Celsius for the R290 refrigerant. That is, the rate of increase in the discharge temperature is lower in the R290 refrigerant than in the R32 refrigerant. Therefore, the SH can be increased when the R290 refrigerant is used.

Further, FIG. 7 shows that the theoretical COPs of R32 and R410A decrease along with the increase in SH, whereas the theoretical COP of R290 increases even if the SH increases. This result comes from the characteristics of R290. The evaporating latent heat of R290 is 1.2 times as large as that of R32. Further, R290 has a great refrigeration effect showing an enthalpy difference between an inlet and an outlet of the evaporator to the increase in SH. At the same SH, the refrigerant circulation amount of R290 that is necessary for a given capacity is 0.8 times as large as that of R32, and the refrigeration effect increases when the SH increases. Therefore, the capacity of R290 hardly decreases even if the SH increases because the increase in the refrigeration effect compensates for the rate of decrease in the refrigerant circulation amount.

Further, the work of the compressor decreases and the input power decreases because of the decrease in the refrigerant circulation amount. Therefore, when the SH increases, the theoretical COPs of R32 and R410A decrease but the theoretical COP of R290 increases. When the SH is secured at the outlet of the evaporator, however, the heat exchanger pipe is dried out and the heat transfer coefficient decreases. In a case of a related-art heat transfer pipe having a bore diameter of about 5 mm to about 8 mm, the heat transfer coefficient reaches a peak at a refrigerant quality of about 0.9 and decreases past the peak as the quality increases as illustrated in FIG. 3.

To reduce influence of the pressure loss in the pipe, heat is exchanged usually by distributing the refrigerant among a plurality of passages, which are called paths. If the refrigerant distribution amounts do not agree with the heat exchange loads in the respective paths, however, the refrigerant quality loses its balance and the SH cannot be secured at the outlet of the heat exchanger. Therefore, a large amount of post-dryout refrigerant or single-phase gas refrigerant is distributed in the heat exchanger. Thus, the heat exchanger performance may decrease.

If the refrigerant flows through the pipe of the heat exchanger as two-phase gas-liquid refrigerant, the heat exchanger performance can be secured. Therefore, the evaporator pressure can be kept at a high level when the heat exchange amount is the same. However, the two-phase gas-liquid refrigerant flows through the second extension pipe after the refrigerant flows through the indoor heat exchanger. In the case of the related-art heat transfer pipe having the bore diameter of about 5 mm to about 8 mm, the pressure loss reaches a peak at a refrigerant quality of about 0.8 to about 0.9 as illustrated in FIG. 9. Further, because of density and viscosity ratios between liquid and gas, the pressure loss in relation to the single-phase gas refrigerant is more likely to increase in the case of R290 than in the case of R410A and R32 of the related art. Therefore, if the two-phase gas-liquid refrigerant flows through the second extension pipe, the influence of the pressure loss is significant and the performance decreases.

In the refrigeration cycle apparatus 500A including the internal heat exchanger 100, the refrigerant can flow through the second heat exchanger 10 in the two-phase gas-liquid state with which the heat exchanger performance is exerted easily. Therefore, in the refrigeration cycle apparatus 500A, superheated gas refrigerant does not flow through the second heat exchanger 10. Thus, the heat exchange performance of the second heat exchanger 10 can be improved. Further, the refrigerant at the inlet of the second heat exchanger 10 is condensed by the internal heat exchanger 100. Therefore, the refrigerant flows into the second heat exchanger 10 in a state closer to the liquid phase in which the quality decreases. Thus, the two-phase gas-liquid refrigerant hardly causes imbalance and the distribution control is facilitated.

In addition, the internal heat exchanger 100 heats the two-phase gas-liquid refrigerant. Therefore, the refrigerant undergoes phase change into higher-quality refrigerant or single-phase gas refrigerant. Thus, the pressure loss on a downstream side of the second extension pipe 509 can be reduced. In the refrigeration cycle apparatus 500A, the pressure loss in the second extension pipe 509 can be reduced. Therefore, a capacity similar to that of R32 or R410A can be exerted along with the reduction of the pressure loss in the second extension pipe 509.

As the refrigerant in the second extension pipe 509 is made closer to the high-quality refrigerant or the single-phase gas refrigerant, the refrigerant density decreases and the filling amount of refrigerant is reduced.

As described above, in the refrigeration cycle apparatus 500A, even when the HC refrigerant such as R290 is used, the decrease in the heat exchanger performance is reduced and the pressure loss is reduced. Thus, the refrigeration cycle performance can be secured and the refrigerant amount can be reduced.

Note that the R290 refrigerant is described as an example but other HC refrigerants such as an R1270 refrigerant can attain similar advantageous effects.

(Other Structure and Advantageous Effects)

Figure 10:
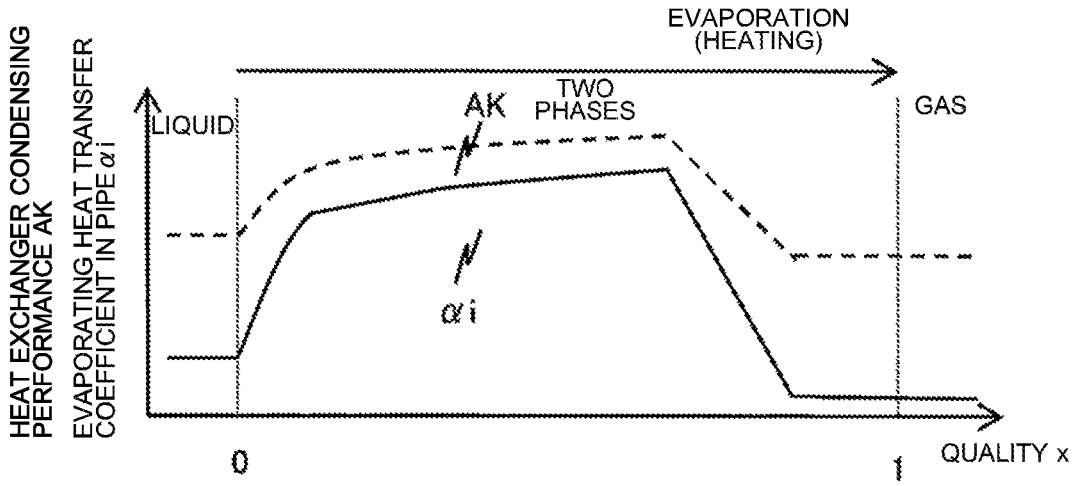
FIG. 10 is a graph showing a relationship between the refrigerant quality and a heat transfer coefficient in a flat multiway tube having an equivalent diameter of about 1 mm.
Figure 11:
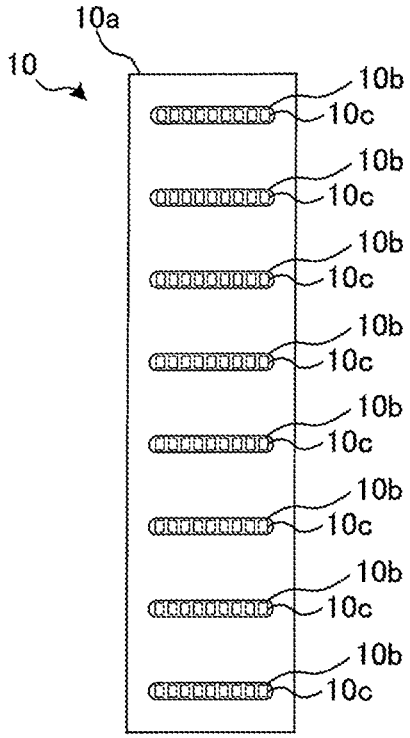
FIG. 11 is an overall structural diagram schematically illustrating a second heat exchanger of the refrigeration cycle apparatus according to Embodiment 1 of the present disclosure when the second heat exchanger is viewed in a refrigerant flow direction.

FIG. 10 is a graph showing a relationship between the refrigerant quality and a heat transfer coefficient in a flat multiway tube having an equivalent diameter of about 1 mm. FIG. 11 is an overall structural diagram schematically illustrating the second heat exchanger 10 of the refrigeration cycle apparatus 500A when the second heat exchanger 10 is viewed in a refrigerant flow direction. The other structure of the refrigeration cycle apparatus 500A and its advantageous effects are described with reference to FIG. 10 and FIG. 11. Description is made below of a structure in which flat multiway tubes are used as the heat transfer pipes of the second heat exchanger 10. That is, as illustrated in FIG. 11, the second heat exchanger 10 is a fin-and-tube heat exchanger including flat multiway tubes 10*b* through which refrigerant flows, and fins 10*a* attached to the flat multiway tubes 10*b*. Each flat multiway tube 10*b* has a plurality of holes 10*c*.

Compared with the related-art heat transfer pipe having the bore diameter of about 5 mm to about 8 mm, the heat transfer coefficient reaches a peak at a low refrigerant quality and decreases past the peak as the quality increases as illustrated in FIG. 10. That is, the heat exchanger performance is more likely to decrease when the outlet of the heat exchanger is in a high-quality condition. Therefore, the internal heat exchanger 100 can exert a greater effect to improve the heat exchanger performance. Further, the volume in the heat transfer pipe can be reduced and the refrigerant amount of flammable R290 can be reduced. Thus, the safety of the refrigeration cycle apparatus 500A increases.

Embodiment 2

Figure 12:
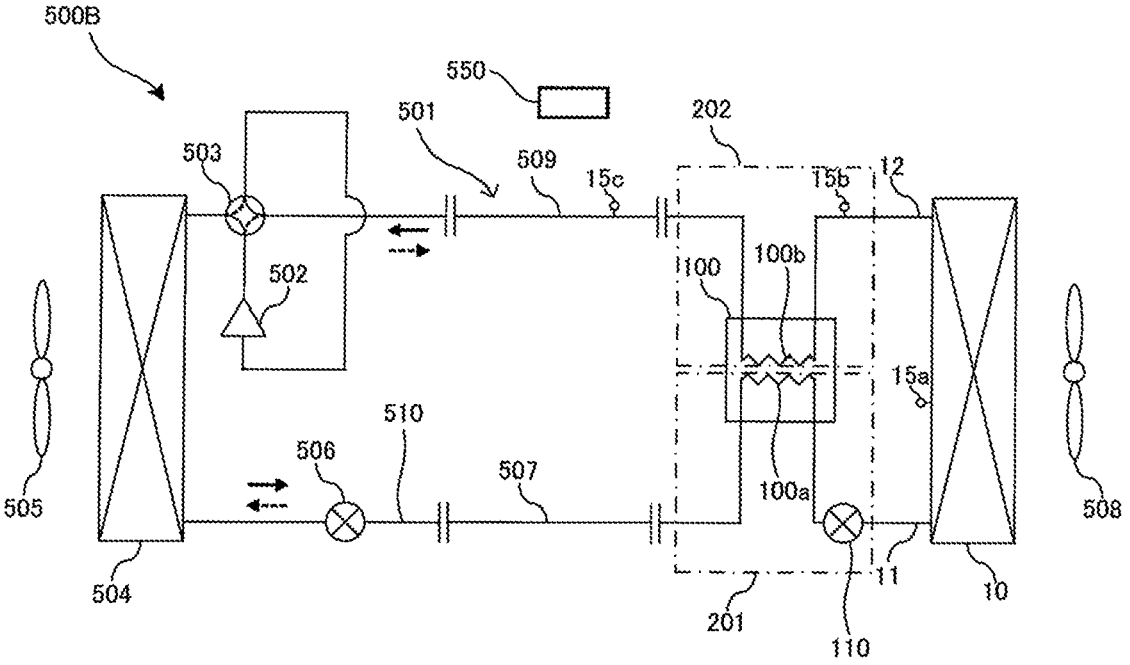
FIG. 12 is an overall structural diagram schematically illustrating an example of the structure of a refrigerant circuit of a refrigeration cycle apparatus according to Embodiment 2 of the present disclosure.
Figure 13:
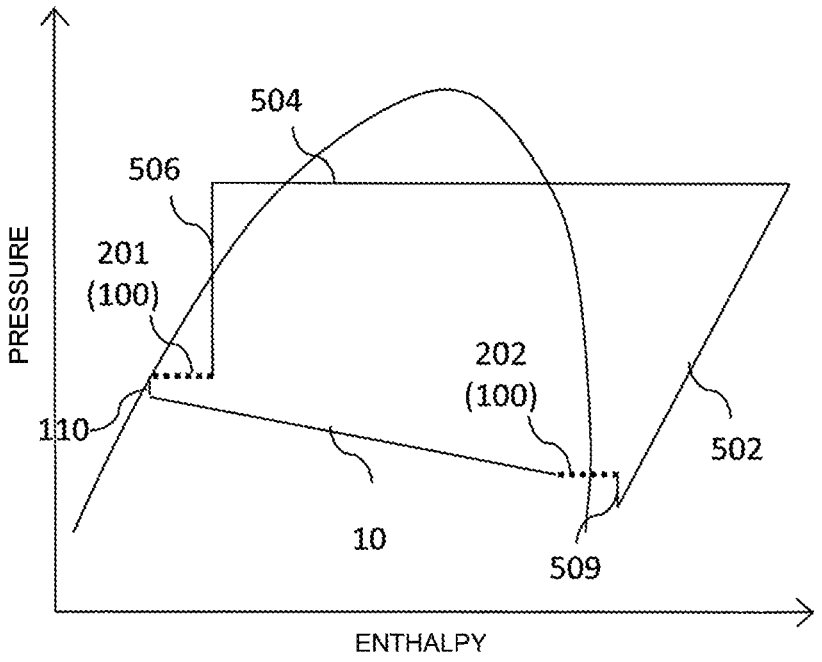
FIG. 13 is a Mollier diagram showing transition of the state of refrigerant in the refrigeration cycle apparatus according to Embodiment 2 of the present disclosure.
Figure 14:
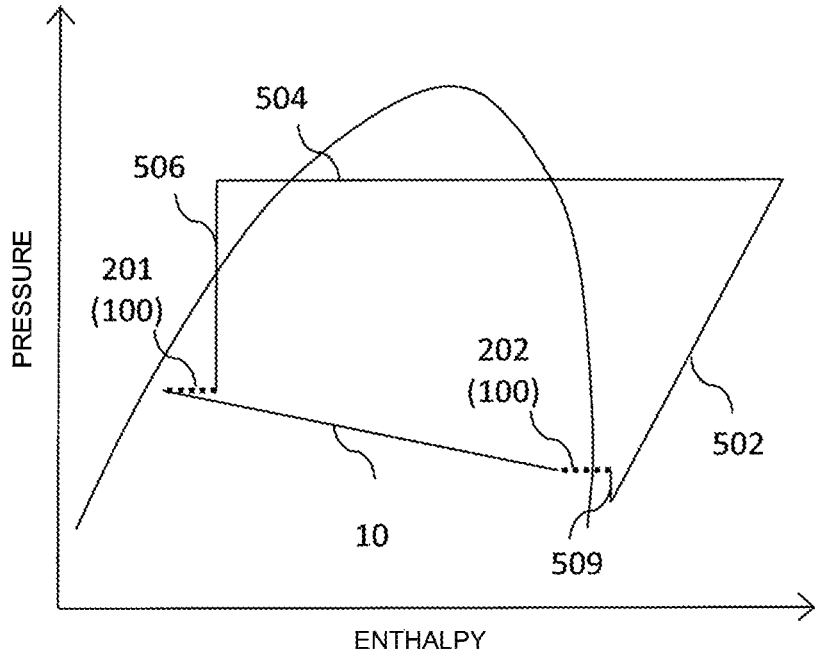
FIG. 14 is a Mollier diagram showing transition of the state of refrigerant in a refrigeration cycle apparatus having no expansion mechanism according to a comparative example.

FIG. 12 is an overall structural diagram schematically illustrating an example of the structure of a refrigerant circuit of a refrigeration cycle apparatus 500B according to Embodiment 2 of the present disclosure. FIG. 13 is a Mollier diagram showing transition of the state of refrigerant in the refrigeration cycle apparatus 500B. FIG. 14 is a Mollier diagram showing transition of the state of refrigerant in a refrigeration cycle apparatus having no expansion mechanism 110 according to a comparative example. The refrigeration cycle apparatus 500B is described with reference to FIG. 12 to FIG. 14.

Note that, in Embodiment 2, differences from Embodiment 1 are mainly described. The same parts as those in Embodiment 1 are represented by the same reference signs and their description is omitted.

The refrigeration cycle apparatus 500B differs from the refrigeration cycle apparatus 500A in that the expansion mechanism 110 is provided between the internal heat exchanger 100 and the second-heat-exchanger liquid port 11 of the second heat exchanger 10. Examples of the expansion mechanism 110 may include a refrigerant pipe, a capillary tube, and an expansion valve.

The following findings can be understood from FIG. 13 and FIG. 14. That is, the expansion value of the expansion device 506 is controlled to the expansion value of the expansion mechanism 110. Therefore, a high-temperature-side refrigerant temperature of the refrigerant flowing into the internal heat exchanger 100, which is called saturation temperature can be increased while a pressure at the second-heat-exchanger liquid port 11 that is similar to the pressure at the second-heat-exchanger liquid port 11 of the refrigeration cycle apparatus 500A is secured. Thus, the heat exchange amount of the internal heat exchanger 100 can be increased. Accordingly, the internal heat exchanger 100 can exert a greater effect to improve the heat exchanger performance.

(Other Structure and Advantageous Effects)

The other structure of the refrigeration cycle apparatus 500B and its advantageous effects are described. Under the condition that the second heat exchanger 10 operates as the evaporator, temperature sensors may be provided in a heat exchange area of the second heat exchanger 10, at the second-heat-exchanger gas port 12 of the second heat exchanger 10, and on an upstream portion of the second extension pipe 509. That is, as illustrated in FIG. 12, a temperature sensor 15*a* is provided in the heat exchange area of the second heat exchanger 10, a temperature sensor 15*b* is provided at the second-heat-exchanger gas port 12 of the second heat exchanger 10, and a temperature sensor 15*c* is provided on the extension pipe 509. The temperature sensor 15*a*, the temperature sensor 15*b*, and the temperature sensor 15*c* are electrically connected to the controller 550 and send information on measured temperatures to the controller 550.

When the plurality of temperature sensors are disposed, the second heat exchanger 10 of the refrigeration cycle apparatus 5006 can operate as the evaporator while the controller 550 checks the temperatures measured by the disposed temperature sensors. That is, the refrigeration cycle apparatus 5006 can operate while the controller 550 checks whether the refrigerant at the second-heat-exchanger gas port 12 is in a two-phase state and whether the refrigerant in the second extension pipe 509 is in a superheated gas state.

Embodiment 3

Figure 15:
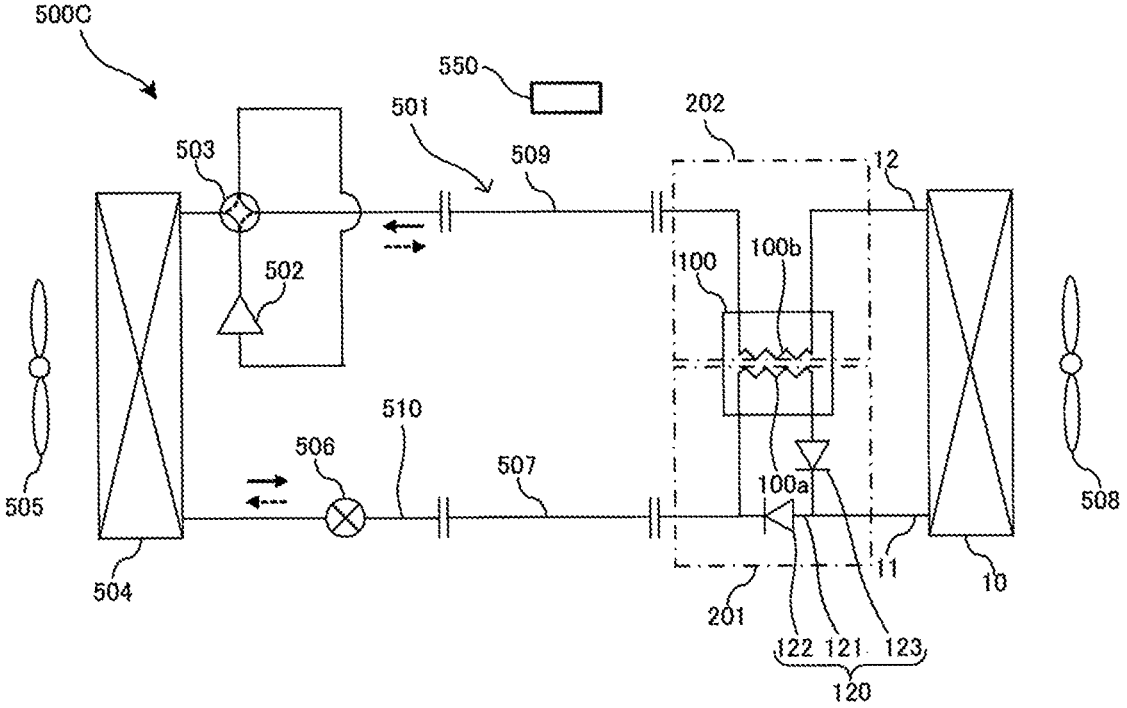
FIG. 15 is an overall structural diagram schematically illustrating an example of the structure of a refrigerant circuit of a refrigeration cycle apparatus according to Embodiment 3 of the present disclosure.

FIG. 15 is an overall structural diagram schematically illustrating an example of the structure of a refrigerant circuit of a refrigeration cycle apparatus 500C according to Embodiment 3 of the present disclosure. The refrigeration cycle apparatus 500C is described with reference to FIG. 15.

Note that, in Embodiment 3, differences from Embodiment 1 and Embodiment 2 are mainly described. The same parts as those in Embodiment 1 and Embodiment 2 are represented by the same reference signs and their description is omitted.

The refrigeration cycle apparatus 500C differs from the refrigeration cycle apparatus 500A and the refrigeration cycle apparatus 500B in that a bypass mechanism 120 is provided to connect the second-heat-exchanger liquid port 11 of the second heat exchanger 10 and the first extension pipe 507 without the passage via the internal heat exchanger 100. That is, under the condition that the second heat exchanger 10 of the refrigeration cycle apparatus 500C operates as the condenser, the refrigerant can flow through the first extension pipe 507 from the second heat exchanger 10 without flowing through the internal heat exchanger 100.

Specifically, the bypass mechanism 120 includes a bypass pipe 121, a first check valve 122, and a second check valve 123. The bypass pipe 121 connects the second-heat-exchanger liquid port 11 of the second heat exchanger 10 and the first extension pipe 507 so that the refrigerant flowing out of the second heat exchanger 10 is guided to the expansion device 506 without flowing through the internal heat exchanger 100. The first check valve 122 is provided on the bypass pipe 121. When the second heat exchanger 10 operates as the evaporator, the first check valve 122 prevents the refrigerant from flowing through the bypass pipe 121. When the second heat exchanger 10 operates as the condenser, the first check valve 122 allows the refrigerant to flow through the bypass pipe 121. The second check valve 123 is provided between an outlet of the first passage 100*a* of the internal heat exchanger 100 and the second-heat-exchanger liquid port 11 of the second heat exchanger 10. The second check valve 123 prevents the refrigerant from flowing from the second heat exchanger 10 toward the internal heat exchanger 100, and allows the refrigerant to flow in the opposite direction.

As the refrigeration cycle apparatus 500C includes the bypass mechanism 120, the internal heat exchanger 100 does not exchange heat when the second heat exchanger 10 operates as the condenser. Therefore, in the refrigeration cycle apparatus 500C, a decrease in condensing capacity can be reduced and a high energy efficiency can be achieved in both the cooling and heating operation modes.

Although the present disclosure is described above with reference to Embodiments 1 to 3, structural details are not limited to those described in Embodiments 1 to 3 but may be modified without departing from the spirit of the disclosure. For example, the refrigeration cycle apparatus may include both the expansion mechanism 110 described in Embodiment 2 and the bypass mechanism 120 described in Embodiment 3.

REFERENCE SIGNS LIST

10 second heat exchanger 10*a* fin 10*b* flat multiway tube 10*c* hole 11 second-heat-exchanger liquid port 12 second-heat-exchanger gas port 15*a* temperature sensor 15*b* temperature sensor 15*c* temperature sensor 100 internal heat exchanger 100-1 internal heat exchanger 100-2 internal heat exchanger 100-3 internal heat exchanger 100*a* first passage 100*b* second passage 110 expansion mechanism 120 bypass mechanism 121 bypass pipe 122 first check valve 123 second check valve 201 first area 202 second area 301 inner pipe 302 outer pipe 303 twisted pipe 310 heat transfer plate 500A refrigeration cycle apparatus 500B refrigeration cycle apparatus 500C refrigeration cycle apparatus 501 refrigerant circuit 502 compressor 503 flow switching device 504 first heat exchanger 505 first fan 506 expansion device 507 first extension pipe 508 second fan 509 second extension pipe 510 refrigerant pipe 550 controller A fluid B fluid

The invention claimed is:

1. A refrigeration cycle apparatus, comprising a refrigerant circuit, by pipes, connecting a compressor, a flow switching device, a first heat exchanger, an expansion device, and a second heat exchanger, as refrigerant to be circulated through the refrigerant circuit, any one of a refrigerant having saturated gas temperature under standard atmospheric pressure that is higher than that of R32 and a refrigerant mixture mainly composed of the refrigerant being used, the refrigerant circuit including an internal heat exchanger configured to exchange heat between the refrigerant flowing through a first passage connected to a refrigerant inlet of the second heat exchanger and the refrigerant flowing through a second passage connected to a refrigerant outlet of the second heat exchanger, a first extension pipe connecting the first passage and the expansion device, and a second extension pipe connecting the second passage and the flow switching device, the compressor, the flow switching device, and the first heat exchanger being mounted in a heat source-side unit, the second heat exchanger and the internal heat exchanger being mounted in a load-side unit, wherein a bypass mechanism is provided to cause the refrigerant flowing through the refrigerant outlet of the second heat exchanger to bypass the internal heat exchanger in a direction in which the refrigerant flows during an operation in which the second heat exchanger is used as a condenser, and wherein the bypass mechanism includes a bypass pipe connecting the refrigerant inlet and the refrigerant outlet of the second heat exchanger, a first check valve provided on the bypass pipe, and a second check valve provided at an inlet of the internal heat exchanger.

2. The refrigeration cycle apparatus of claim 1, wherein the refrigerant is flammable.

3. The refrigeration cycle apparatus of claim 1, wherein the second heat exchanger includes a flat multiway tube through which the refrigerant flows, and a fin attached to the flat multiway tube.

4. The refrigeration cycle apparatus of claim 1, wherein an expansion mechanism is provided between the internal heat exchanger and the refrigerant inlet of the second heat exchanger in a direction in which the refrigerant flows during an operation in which the second heat exchanger is used as an evaporator.

5. The refrigeration cycle apparatus of claim 1, further comprising:

a temperature sensor provided in a heat exchange area of the second heat exchanger;

a temperature sensor provided at the refrigerant outlet of the second heat exchanger in a direction in which the refrigerant flows during an operation in which the second heat exchanger is used as an evaporator;

a temperature sensor provided between the internal heat exchanger and the flow switching device; and a controller electrically connected to the temperature sensors, wherein the controller is configured to execute the operation in which the second heat exchanger is used as the evaporator on a basis of temperature information sent from the temperature sensors.

6. The refrigeration cycle apparatus of claim 1, wherein the internal heat exchanger is a double-pipe heat exchanger or a plate heat exchanger.

7. The refrigeration cycle apparatus of claim 1, wherein, when the second heat exchanger operates as an evaporator, the refrigerant at the refrigerant outlet of the second heat exchanger is in a two-phase state and the refrigerant in a refrigerant inlet of the second extension pipe is in a superheated gas state.

* * * * *